United States Patent [19]

Degut

[11] Patent Number: 4,630,418

[45] Date of Patent: Dec. 23, 1986

[54] APPARATUS OF CONSTRUCTION BY MEANS OF PREFABRICATED ELEMENTS, PARTICULARLY OF WOOD

[75] Inventor: Andre Degut, Pomeys, France

[73] Assignee: Societe A. Degut, France

[21] Appl. No.: 650,355

[22] Filed: Sep. 13, 1984

[30] Foreign Application Priority Data

Sep. 20, 1983 [FR] France ..... 83 15372
Feb. 23, 1984 [FR] France ..... 84 03187

[51] Int. Cl.[4] ..... F04B 1/10; E04C 3/02; E04C 3/30

[52] U.S. Cl. ..... 52/264; 52/270; 52/593; 52/595

[58] Field of Search ..... 52/264, 293, 274, 270, 52/593, 595

[56] References Cited

U.S. PATENT DOCUMENTS

| | | | |
|---|---|---|---|
| 2,184,464 | 12/1939 | Myers | 52/293 X |
| 2,208,589 | 7/1940 | Leemhuis | 52/274 X |
| 2,362,162 | 11/1944 | Sheldon | 52/293 X |
| 2,639,606 | 5/1953 | Boss et al. | 52/293 |
| 3,369,335 | 2/1968 | Smith | 52/274 X |
| 3,623,288 | 11/1971 | Horowitz | 52/293 |
| 3,842,554 | 10/1974 | Swick | 52/264 X |
| 3,898,779 | 8/1975 | Tracy | 52/264 |
| 3,958,388 | 5/1976 | Hawes | 52/270 X |
| 4,219,978 | 9/1980 | Brown | 52/274 X |

FOREIGN PATENT DOCUMENTS

| | | | |
|---|---|---|---|
| 463197 | 5/1954 | Belgium . | |
| 503197 | 5/1954 | Canada | 52/264 |
| 801852 | 1/1951 | Fed. Rep. of Germany | 52/293 |
| 1214855 | 4/1962 | Fed. Rep. of Germany . | |
| 496027 | 7/1919 | France . | |
| 2469279 | 11/1979 | France . | |
| 1250293 | 10/1971 | United Kingdom | 52/270 |

OTHER PUBLICATIONS

FLL., 1970, Paris (FR) No. 114, Cahiers DU CSTB.

*Primary Examiner*—Stuart S. Levy
*Assistant Examiner*—Joseph J. Hail, III
*Attorney, Agent, or Firm*—Steele, Gould & Fried

[57] ABSTRACT

A building device is provided which is particularly useful for building small houses, garages and shelters. The device includes a frame for abutting the ground which is contoured in the section to permit the positioning of vertical panels there against. There are essentially two different types of panels, each of the panels having transverse edges with complementary contours arranged vertically in order to permit their combined dissembly in juxtaposition at either an angle of 180 degrees or 90 degrees. A chaining is provided atop the panels and is conformed to cooperation with the upper portion of the panels and once in position serves as a peripheral reinforcing belt around the panels and permits the direct mounting of roofing elements or superimposed panels there against. In addition, vertical elements in the form of posts are mounted at right angles in openings in the panels, the posts being arranged to permit the positioning and centering of door frames, window frames and the like and in addition, to handle the mounting and positioning of panels at either an angle of 90 or 180 degrees.

19 Claims, 13 Drawing Figures

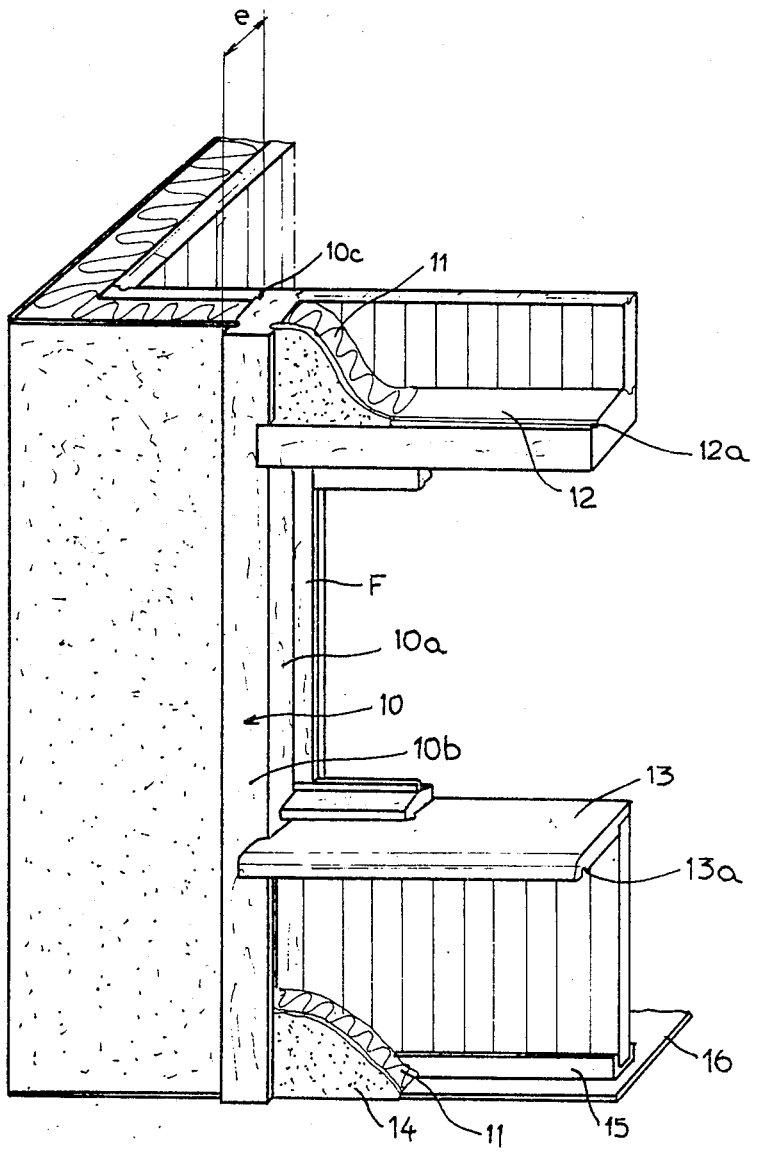
FIG. 1bis

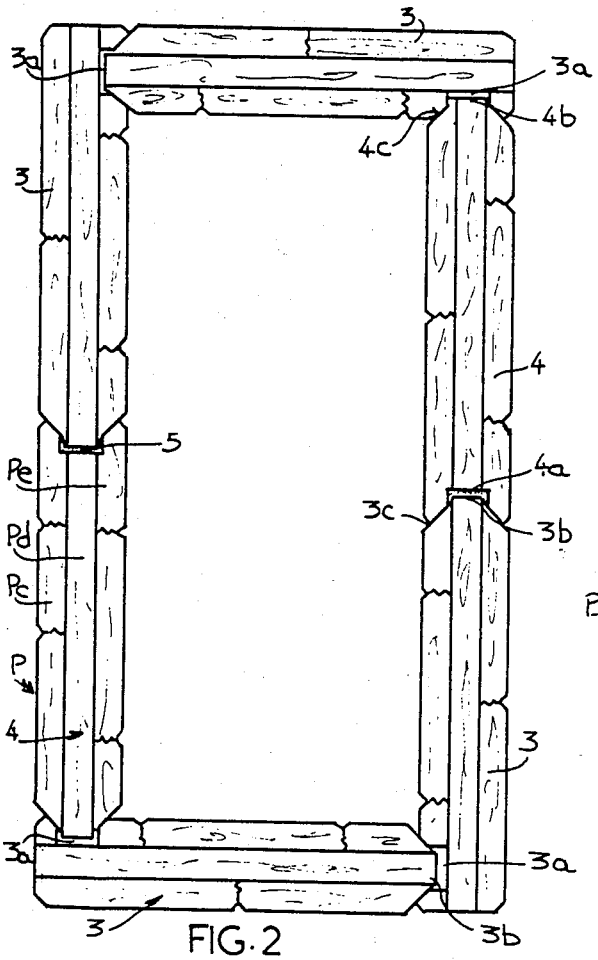
FIG. 2
FIG. 3
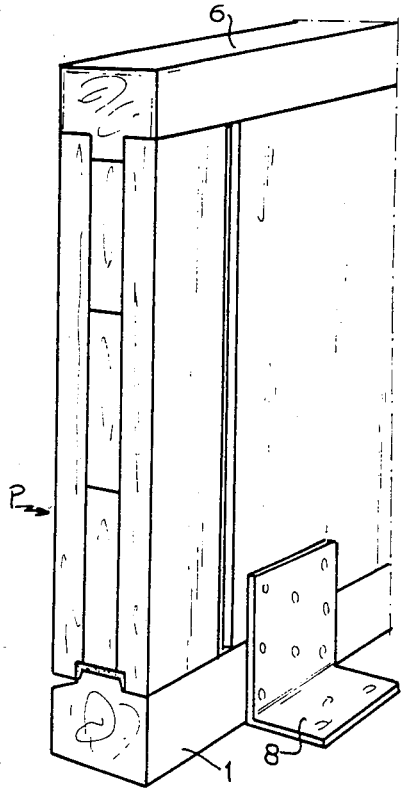
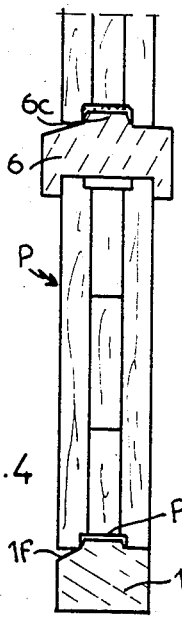
FIG. 4
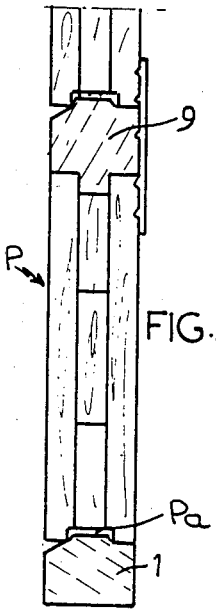
FIG. 5
FIG. 6
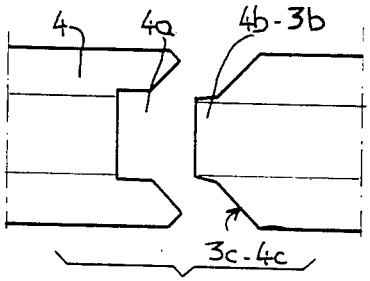
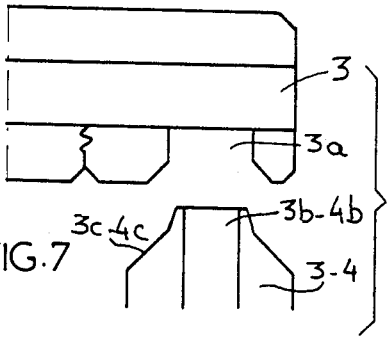
FIG. 7

APPARATUS OF CONSTRUCTION BY MEANS OF PREFABRICATED ELEMENTS, PARTICULARLY OF WOOD

The invention has for its object a building device by means of prefabricated elements, more particularly of wood.

The object of the invention pertains to the art unit of the building elements.

In accordance with the invention, there has been provided in a particularly simple and advantageous manner a construction based on prefabricated and preformed elements the particular structure and the assembly and positioning combination of which permit the quick and ready implementation of various types of constructions or buildings by any person, however unskilled this person may be in the technical fields of reference. The invention is more particularly directed, however not limitatively, to the constructions for residential use, such as the house and bungalows, the garages, the shelters.

The use of the device gives many possibilities of architectures and of dimensional extensions, immediately or in the future.

For this purpose, the device is remarkable in that it includes essentially, in combination, a frame for abutment to the ground, contoured in section for the positioning of vertical panels, said panels being essentially of two different types and having transverse edges with complementary contours arranged vertically in order to permit the combined assembly thereof in juxtaposition at 180° and at 90° more particularly; a chaining being conformed for capping the section of the upper part of the panels, more particularly after the mounting of the latter, while serving as a peripheral reinforcing and positioning belt and permitting the direct mounting of roof elements or of superimposed panels.

The constituent elements of the window and/or door assemblies such as the casings, the cross pieces, the crank pieces, the jambs, the lintels, have in combination in a complementary manner assembly grooves and ribs the edges of which are bevelled with a profile slanting for quite nearly 45°, in a manner corresponding to the wall panels.

Posts are mounted at right angles to the openings and are provided perpendicularly to their lateral and/or transverse faces with grooves, or ribs, for mounting and positioning the panels to 90° or 180°.

These and further characteristics will be apparent from the following description.

The object of the invention will be set forth more clearly with reference to the accompanying drawings, without however being restricted thereby. In the drawings:

FIGS. 1 and 1 bis are perspective views showing the various elements of the device positioned for building a house; some of these elements are shown prior to mounting and assembling.

FIG. 2 is a longitudinal sectional view considered along the line 2—2 of FIG. 1.

FIG. 3 is a partial perspective sectional view considered along the line 3—3 of FIG. 2.

FIGS. 4 and 5 are sectional views showing two examples of embodiments for the vertical assembly of a plurality of panels.

FIG. 6 shows on a larger scale the complementary ends of two elements to be assembled in juxtaposition and in line.

FIG. 7 shows on a larger scale the complementary ends of two elements to be assembled at an angle of 90 degrees.

Figure 8:
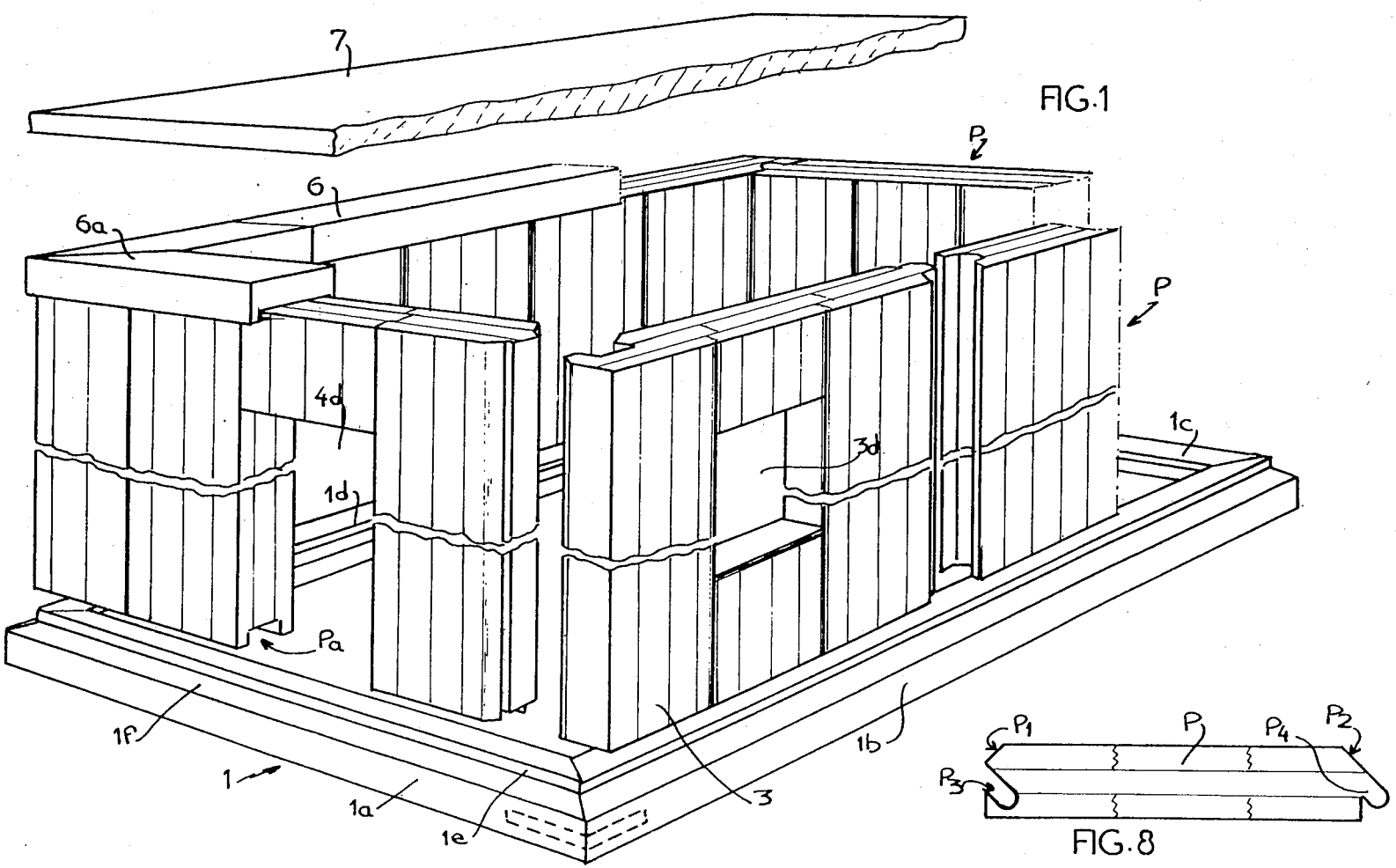
FIG. 8 is a partial perspective view showing more particularly the main constituent elements of the device, opposite an opening, said elements being shown prior to assembling them for the building of a house more particularly.
Figure 10:
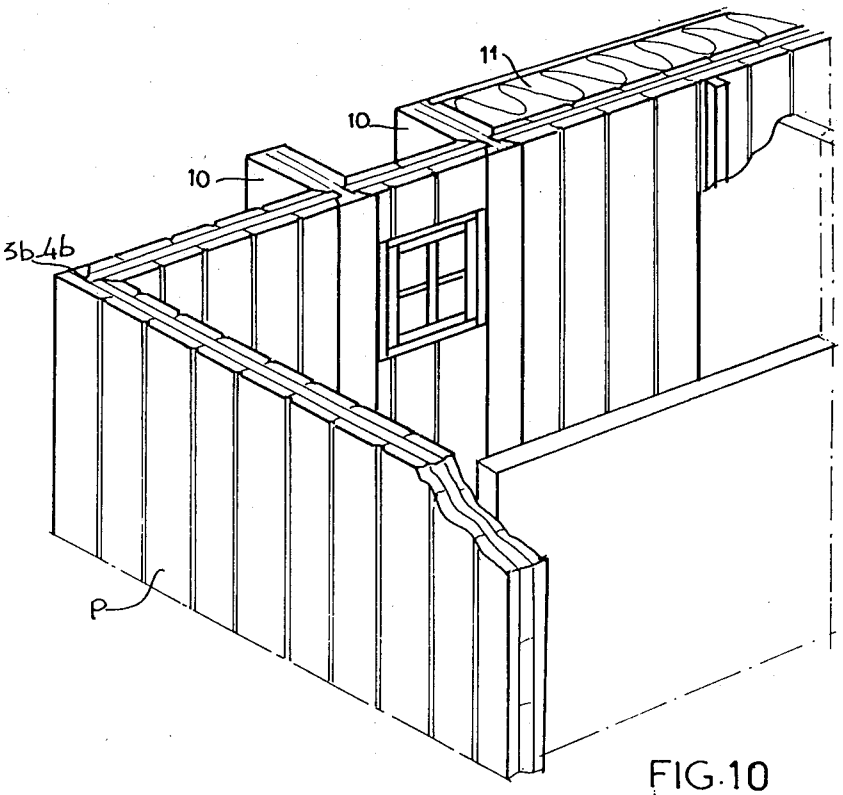
FIG. 10 is on a larger scale a cross sectional view considered at an angle to a window.
Figure 9:
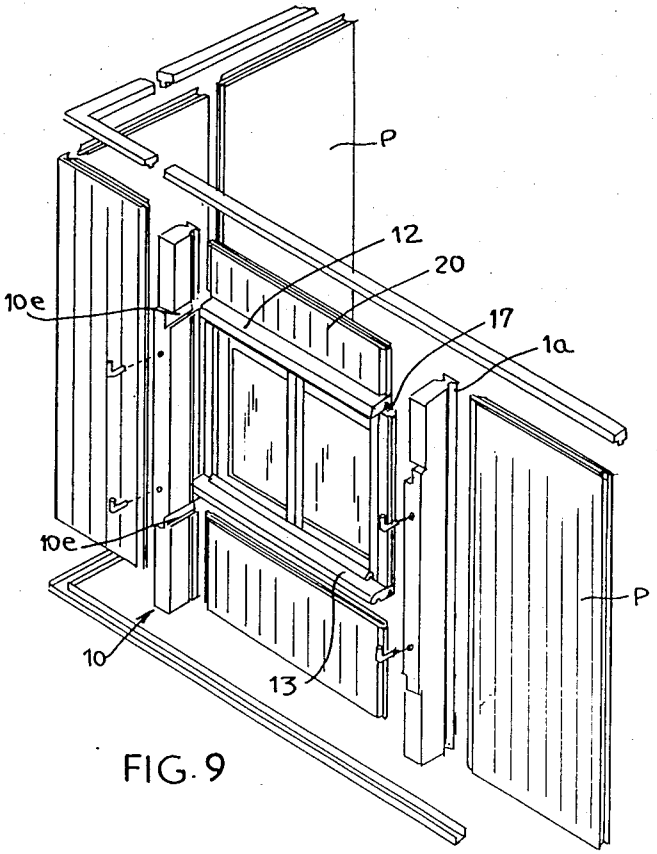
FIG. 9 is a partial perspective view showing the inside of a house in accordance with the invention.

To make the object of the invention more concrete, the invention will be described now in a non restrictive manner, with reference to the examples of the drawings.

A more particularly advantageous embodiment of the device in accordance with the invention may be seen in FIG. 1, for the construction of a house with a framework of wood.

Generally, the device includes a base frame (1) for abutment to the ground, conformed in order to permit the mounting and positioning of vertical panels denoted on the whole by the reference letter (P).

The frame (1) consists at least of four elements **(1*a*), (1*b*), (1*c*) and (1*d*), the ends of which are cut away at an angle of 45° to form after mounting, in the example illustrated, a quadrangular assembly of internal angles of 90°. Each angle can be fixed in position by means of an internal square (2) the arms of which are engaged within the thickness of two adjacent elements (1*a* and 1*b*) (FIG. 1). The sides of the frame (1)** can be made of one or more parts assembled and positioned by any well known and convenient means (grooving and feathering joint, glue).

In a form of embodiment, each element of the frame (1), quite nearly in the medial portion thereof, has a projecting positioning rib **(1*e*) the lateral sides of which are very slightly bevelled. This rib (1*e*) is to be connected to the vertical external sides of the frame (1) with a sloping face (1*f*) for the outflow of water more particularly, (FIG. 3**).

The entire frame (1), made in this manner, is secured to the ground by means of metal dowels for example. The main purpose of this frame is to guide the alignment and the squaring of the wall panels (P) and to maintain the stiffness and the possible distortion of the ground. Each panel is provided, at least at the base thereof, with a longitudinal groove cooperating with the rib **(1*e*)** of the frame for the vertical positioning thereof. In accordance with the invention, panels of two different types are to be substantially discriminated, in order to provide, by means of their complementary profile of assembly, a positioning at an angle of 90 degrees or 180 degrees.

For this purpose, the panels of the first type (3) are provided, vertically and facially along the whole height thereof, with a groove **(3*a*) formed perpendicularly to one of the lateral faces of the panel and adjacent to one of the transversal edges. At the opposite end of the squared groove (3*a*), the transverse side of the panel (3)**

is provided axially and along the whole height thereof with a vertical rib (3*b*).

The panels of the second type (4) are provided with a transverse side which is grooved axially at (4*a*) along the whole height of these panels, while the other opposite side is provided axially with a vertical rib (4*b*) in the same way as the panels (3). The sectional contour of the ribs (3*b* and 4*b*) is complementary to the profile of the grooves (3*a* and 4*a*), so that said ribs will be capable of cooperating with any one of the grooves (3*a* or 4*a*).

Towards the ribs (3*b* and 4*b*), and on either side thereof, the edges of the panels (3 and 4) are bevelled in the vertical direction with a slanting profile (3*c* and 4*c*) of very nearly 45 degrees (FIGS. 6 and 7). In a complementary manner, the edges of the grooves (3*a* and 4*a*) is bevelled for 45 degrees at (3*d* and 4*d*).

The result is that after the mounting in juxtaposition of a plurality of panels which are adjacent either at 90 or at 180 degrees, the ribs (3*b*) and/or (4*a*) are engaged within the corresponding complementary grooves (3*a*) and/or (4*a*), the slanting profiles (3*c*) and/or (4*c*) being abutted against the bevelled edges (3*d*) and (4*d*) of said grooves.

The height of the ribs (3*b*) and (4*b*) is lower than the depth of grooves (3*a*) and (4*a*), so that after the positioning in juxtaposition of two adjacent panels (3—3), (3—3), (3–4) or (4—4), there remains a gap for placing a seal (5).

After mounting and positioning the various panels (3) and (4) in combination with the base frame (1), the assembly is surrounded in the top portion by a chaining (6) shaped in section to cap the thickness of the panels.

In a preferred manner, this chaining consists of preformed angle elements (6*a*) and of intermediary elements (6*b*). From such a chaining it is possible to begin quite easily the assembly from an angle and to hold this angle substantially in position by means of the chaining elements (6*a*).

Chaining (6) serves as a support and as fastening means for the framing elements, and is used directly for the roof elements (7) (FIG. 1).

The various constituent elements of the chaining (6) are also provided in projection with an axial rib (6*c*) in order to permit the mounting and the positioning in superimposition of panels (3 and 4) in the case of a construction on a plurality of levels (FIG. 4), the bottom grooves (Pa) of the panels being in such a case centered on the ribs (6*c*).

As stated previously, the depth of the grooves (Pa) of the panels is greater than the height of the ribs (1*e*) or (6*c*), in order to have after the assembly a gap permitting the placing of a seal. It will be noted that each one of the panels (3 and 4) may be provided with a longitudinal groove for positioning with the abutment frame (1) (or with the chaining (6)) both in the lower part and in the upper part, for more flexibility of use of the panels.

Each panel (P), either of the first or of the second type, includes a plurality of layers, and more particularly three layers (Pc), (Pd) et (Pe) respectively comprised of an assembly in juxtaposition of wood blades. The various thicknesses (Pc), (Pd) and (Pe) are oriented in the same direction, while being situated perpendicularly to the grains of the wood blades of the intermediate layer (Pd).

It will be obvious that some of the wall panels (3) and (4) are provided in a known manner with openings (3*d* or 4*d*) for the location of windows or doors (FIG. 1.)

In a particularly important manner, it will be pointed out that on either side of the openings (doors and/or windows), it has been contemplated to mount vertical elements (10) serving more particularly as rigidity posts or as jambs (FIG. 1 bis).

Each post (10) pertains to the same technological concept as the panels (P) and is provided perpendicularly to its lateral faces (10*a*) or transversal faces (10*b*) with grooves (or ribs) (10*c*) for the assembly and the positioning of the panels (P) at 90° or 180°. The thickness (e) of the posts (10) is greater than the thickness of the panels (P) in order to project perpendicularly after the assembly, and to provide a suitable clearance for receiving any insulating means (11).

In the same way as the panels (P), the edges of the grooves (10*c*) are extended towards the outside with a slanting profile (10*d*) of very nearly 45°, in a complementary manner in regard to the contoured ribs (3*b* and 4*b*) of said panels.

The grooves (10*c*) are formed adjacent to the transversal edge of the jamb (10), perpendicularly to each one of the lateral faces (10*a*) of said jamb while being directly opposite.

The posts (10), in combination with the grooves (10*c*), permit the automatic assembly and positioning of the window and/or door elements.

Figure 11:
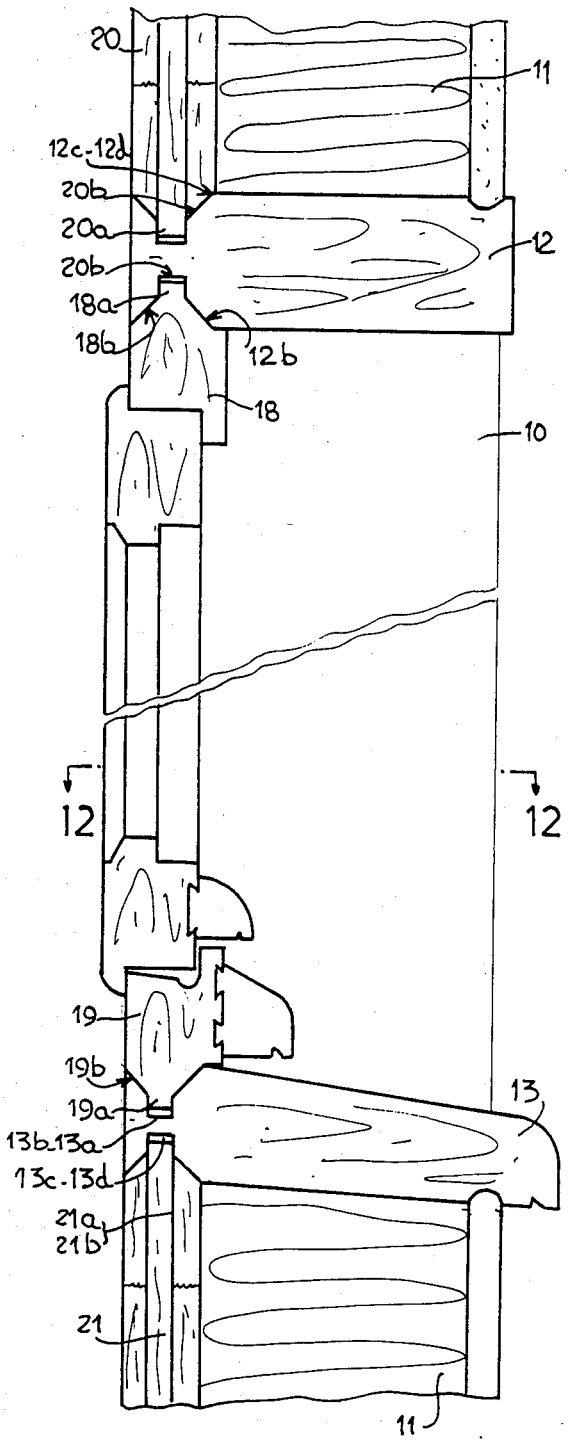
FIG. 11 is a sectional view considered along the line 11—11 of FIG. 10.
Figure 12:
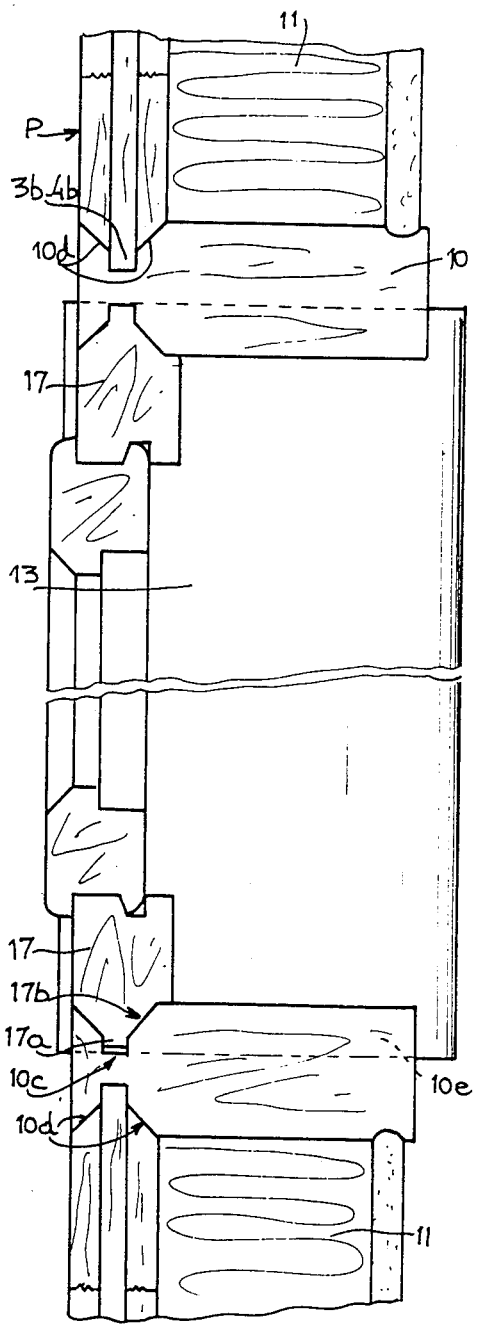
FIG. 12 is a sectional view taken along line 12—12 of FIG. 11.

For this purpose, the casings (17) of the windows (F) are provided vertically with a rib (17*a*) the edges of which are bevelled in a symmetrical manner and form a slanting profile (17*b*) capable of cooperating with the contoured grooves (10*c*) of the posts (10) (FIG. 11).

The upper (18) and lower (19) crosspieces of the windows are provided each one along their entire length with ribs (18*a*–19*a*) the edges of which are bevelled in a symmetric manner to form a slanting profile (18*b*–19*b*). The contoured rib (18*a*–18*b*) of the upper crosspiece (18) cooperates with a contoured complementary groove (12*a*) formed along the whole length of and adjacent to the longitudinal edge of a lintel (12), and perpendicularly to the underside. The edges of the groove (12*a*) are bevelled towards the outside, in a symmetric manner, to constitute a slanting profile (12*b*).

The upper face of the lintel (12) is provided opposite the groove (12*a*–12*b*) with a further symmetric contoured groove (12*c*–12*d*), capable of cooperating with the footing of the panels (20) serving as a transom. The footing has a rib (20*a*) the edges of which are bevelled by a slanting profile (20*b*).

The contoured rib (19*a*–19*b*) of the lower crosspiece (19) cooperates with a contoured complementary groove (13*a*–13*b*) formed longitudinally adjacent to the internal edge of a crank piece (13).

Symmetrically and opposite the contoured groove (13*a*–13*b*), the underside of the crank piece can be provided with a further groove (13*c*–13*d*) capable of cooperating with a contoured complementary groove (21*a*–21*b*) provided on panels (21) serving as a basement.

The lintel (12) and the crank piece (13) are engaged and positioned within transverse notches (10*e*) provided on the internal faces of the jambs (10).

In the same way as this has been provided concerning the panels (P), the height of the various ribs of the constituent elements of the window is lower than the depth of the grooves of the corresponding elements, so that after the assembly, there remains a gap for the possible laying in of a seal.

It will be pointed out that in order to prevent any shrinking effect, the wood grains or veins of the intermediate layer (Pd) of the various panels and elements are disposed perpendicularly to the joining and assembly plane.

In an alternative form of embodiment, a rabbet can be provided along the entire height or on a portion of the height of the posts in order to permit a window (F) to be embedded. A groove is also provided for the location of a seal for possible shutters. The lintels (12) and the crank pieces (13) can be merely mounted by embedding and encasing in combination with the vertical elements (10).

The upper faces of the lintels (12) and the lower faces of the crank pieces (13) can be provided with grooves (12*a*)–(13*a*) in order to facilitate the coating of an external rendering (14) applied in a known manner onto the insulating material (11).

In a further alternative form of embodiment, the base supporting frame (15) is made of U-shaped elements the vertical legs of which permit the embedding of various panels. This frame (15) can be secured to a flagstone of concrete (16) protruding outwardly and peripherally from said frame in order to permit the partial seating of the insulating material (11), so that the rendering (14) will project from the flagstone and serve as water droplet.

Mounting and assembling a house, for instance, by means of the elements of the device in accordance with the invention, can be done in a particularly ready and quick manner, without the necessity of specific skill and knowledge in the art.

After fitting the base frame or framework (1 or 15), it is merely necessary to position the various panels (P) in combination with the profile of the frame. It is possible for instance to form a corner by taking a panel (3) of the first type and a panel (4) of the second type (as the case may be, two panels (3) in the case of a reduced size (FIG. 2)).

The pre-formed square (6*a*) relative to the chaining (6) can thereafter cap the two aforesaid panels, in order to hold the starting point of the construction truly squared. The same procedure is carried out for mounting the other adjacent panels, pre-formed seals being interposed between the various assembly grooves and ribs, as stated before.

In the case of a one-level construction, the framing or the roof elements, once the assembly has been performed and the chaining has been secured, are mounted on said chaining (6).

The various wall panels (P) can be secured in combination with the base frame, for instance by means of a square (8). It will be noted that the various seals are capable of providing the securing of the various elements: the panels between them and relative to the base frame for instance.

For a construction with a plurality of levels, it has been seen that the chaining elements (6) can be arranged for receiving in superimposition various other wall panels (FIG. 4). Or also in an alternative form of embodiment (FIG. 5), the peripheral frame (9) identical to the abutment base frame (1) is secured by any well known and suitable means on the periphery of the panels.

As soon as the location of a window or a door-window opening is arrived at, it is merely necessary to encase a post (10) at right angles to this opening, to slip the upper transom and to encase the shutters and the windows which will be automatically dimensioned by the system. The continuity is provided by the addition of solid panels up to the next opening.

As an indication, this repeat cycle with three persons, without tooling, makes it possible to complete the whole of the walls, windows and shutters within one day, for a house of approximately 100 sqm. Two days approximately are necessary for the installation of the prefabricated framing, and three days approximately for the roofing, which permits a house of 100 sqm for three persons, watering and airing excepted, to be mounted in less than 10 days.

The invention is particularly interesting for building of houses, however the invention finds also its use for making shelters, garages, furniture . . . .

Among other advantages, the following ones are more particularly to point out:

the mode of construction can be sold in kit, and permits the embodiment of many designs on the architectural plane. It is possible to obtain the mounting of the kit, the immediate dimensions of the shutter and of the window, without measuring instrument (rule, plumbline) and without handling material, which is a substantial economy in the construction. Moreover, a house can be built by any person, without the necessity of particular skill for this purpose.

The prefabricated corners of the chaining have the effect to be always squared.

The particular conformation of the chaining can serve directly as a support for roofing elements, or can be useful to permit the mounting in superimposition of panels, in order to create one or more complementary levels, even several years after the construction of the first level.

The grooving in the vertical direction of the panels with a slanting profile provides a clearance for the wood, while preserving the joining of the assembly.

The particularly advantageous application of the structure of the panels to various layers of juxtaposed blades of wood imparts a substantial rigidity and insulation.

Finally, it will be pointed out that the base abutment frame (1) or (15) can be conformed or equipped with means for the installation of a floor of any convenient type.

Likewise, in an alternative form of embodiment, the panels (P), in any form in which they may be made, are provided with at least two vertical ridges (P1) and (P2) which are bevelled at an angle of very nearly 45° and formed from the same lateral face of the panel (FIG. 8). In that case, one of the transversal sides of the panel is provided along the whole height thereof with a vertical groove (P3) which is formed angularly at an angle of 45° from the end of the ridge (P1) for instance, i.e. at an angle of 45° relative to said transversal side.

The other transversal side of the panel (P) is provided vertically along the entire length thereof, within the extension of the opposed bevelled ridge (P2), a rib (P4) which is parallel to the groove (P3), and has a complementary profile.

Therefore, this rib (P4) is disposed angularly at an angle of 45° relative to the transversal side of the panel, and is destined to cooperate with the rib of an adjacent panel by being encased slidably therein.

These assembly profiles permit a mounting in juxtaposition of the panel, not only at an angle of 180° for instance, but also at an angle of 90° for example. In the latter case, it is merely necessary to make angularly the grooves and the ribs from the edge of one of the lateral sides of the panel, and not more of one transversal side.

Such an inter-assembly of the panels has many advantages:

the slidable encasing permits at the same time to interhook the blades, constituting thus a self-assembling profile of several blades, in order to form a panel without fasteners, without glue . . . .

This gives also the possibility of a shrinking of the wood for several millimeters, without allowing a break of joining to appear between the boards.

Moreover, in the case of panels consisting of three staggered wood blades, should an unsticking at the joining occur, the assembly angular contour will prevent a raising, as the blades are not individual any more thanks to this novel assembly contour.

It will be obvious that these angular assembly profiles are particularly useful within the scope of the invention, but also for making garage door panels . . . .

In addition to the foregoing advantages, there must be noted the faultless sealing which is achieved, as the various panels and ellements are all assembled by sticking with the possible interposition of a sealing means in the bottom of the various grooves.

The windows and the doors, owing to their specific assembly profile, in combination with the posts or jambs (10), are mounted automatically and simultaneously with the wall panels (P), in a faultlessly squared manner. Centering V are provided by the complementary profiles of the grooves and ribs.

In the case of a house with two levels and more, the posts (10) go up to the top of the house.

It will be obvious that the thickness of said posts may be very nearly equal to the thickness of the panels (P) when an outward insulation is not desired.

I claim:

1. In a building device particularly for building small houses, garages, shelters, doors and shutters, by means of a plurality of panels having transverse sides and lateral surfaces, the improvement which comprises in that each of said panels includes at least two vertical ridges bevelled in the vertical direction with a slanting profile at an angle 45° and formed from the same lateral surface, one of the transverse sides of said panel being provided along the entire length with a vertical groove which is formed at an angle of about 90° from the end of one of said ridges, the other transverse side of the panel being provided vertically along the entire length within the extension plane of the the other of said ridges with a rib parallel to said vertical groove and having a complementary contour.

2. The device of claim, 1 wherein panels of a first type are provided vertically and facially along their whole height with a groove formed perpendicularly to the lateral faces of the panel and in proximity to one of the transverse sides, the other transverse side having axially, along the whole length thereof, a surface rib.

3. The device of claim, 1 wherein the panels of a second type have a side which is grooved axially along the whole length, the other transversal side having axially a vertical rib.

4. The device according to claim 3, wherein the sectional contour of the ribs is complementary to the contour of the grooves, the depth of said grooves being greater than the height of the ribs for creating a space for placing seal means.

5. The device of claim 4, wherein both sides of the ribs, and the edges of the panels are bevelled in the vertical direction with a slanting profile inclined about 45°, the edges of the grooves being bevelled in a complementary manner.

6. The device according to claim 1, wherein each panel includes three layers, consisting respectively of an assembly of wood blades in juxtaposition, the various thicknesses being in superimposition so that the grains of the outside layers are oriented in the same direction while being disposed perpendicularly to the grains of blades of the intermediate layer.

7. A building device for use in building small houses, garages, shelters and the like, comprising in combination, a support for abutting the ground, said support being contoured in sections for positioning panels, vertical panels for mounting in said support, said panels comprising a plurality of layers, said panels being essentially of two different types and having transverse edges with complementary contours arranged vertically for allowing assembly in juxtaposition at 90° and 180°; chaining or linking means cooperating with the upper portion of said panels, said chaining means forming a peripheral reinforcing means for permitting the mounting of roofing members or superimposed panels, and a plurality of vertical post means having grooves for mounting in cooperation with said panels, said post means extending through the entire height of the construction and means having profiled grooves perpendicular to the lateral surfaces of said panels and in proximity to the transverse edges of said post means for allowing the positioning and centering of the frames of door, or window members, and for the mounting and positioning of said panels at about 90° or about 180° said door frame or window member being provided vertically with a rib, the edges of which are bevelled in a symmetrical manner for forming an inclined contour capable of cooperating with the grooves of the post means.

8. The device according to claim 7, wherein the grooves of the post means are disposed in a perpendicular manner to the side surfaces and adjacent to the external transversal edge of the posts opposite, for permitting the assembly and the positioning of the vertical complementary contours of the panels, and for permitting the mounting and the positioning of the various constituent elements of the doors and windows.

9. The building device claim 7, wherein said door or window elements are provided in combination, in a complementary manner, with assembly grooves and ribs the edges of which are bevelled with a slanting profile at an angle of about 45°, in a manner corresponding to the bevelling of the wall panels.

10. The building device of claim 7, wherein the linking means is comprised of preformed angles and of intermediate elements.

11. The building device of claim 7, wherein each panel is provided at the bottom thereof with a longitudinal groove cooperating with a rib of the support, said grooves having a depth which is greater than the height of the rib in order to constitute an interval for permitting placing insulation means.

12. The building device of claim 7, wherein said panels are wooden and comprise three layers, the grains of the outside layers being oriented in the same direction and are disposed perpendicularly to the grains of the sheets of wood of the middle layer so as to reduce a shrinking effect.

13. The building device of claim 7, wherein the door or window members are provided with complementary grooves and ribs with edges bevelled at about 45°.

14. A building device for use in building small houses, garages, shelters and the like, comprising in combination, a support for abutting the ground, said support being contoured in sections for positioning panels, vertical panels for mounting in said support, said panels comprising a plurality of layers, said panels being essentially of two different types and having transverse edges with complementary contours arranged vertically for allowing assembly in juxtaposition at 90° and 180°; chaining or linking means cooperating with the upper portion of said panels, said chaining means forming a peripheral reinforcing means for permitting the mounting of roofing members or superimposed panels, and a plurality of vertical post means for mounting in cooperation with said panels, said post means extending through the entire height of the construction and profiled grooves perpendicular to the lateral surfaces of said panels and in proximity to the transverse edges of said post means for allowing the positioning and centering of the frames of door and window members, and for the mounting and positioning of said panels at about 90° or about 180°, said window members having upper cross pieces and lower cross pieces, said cross pieces having ribs, the edges of which are bevelled in a symmetrical manner with a slanting profile cooperating respectively with a complementary groove of a lintel and a crank piece.

15. The device of claim 14, wherein the upper surface of the lintel is provided opposite a groove, in a symmetrical manner, with a further groove for cooperating with a complementary rib formed at the bottom of said panels.

16. The device of claim 14, wherein the lower surface of the crank piece is provided opposite a groove, in a symmetrical manner, with a further groove for cooperating with a complementary rib provided on the panels.

17. The building device of claim 14, including lintels and crank pieces which are engaged and positioned within transverse slots provided on the inside faces of sideposts.

18. The building device of claim 17 wherein the thickness of said posts is greater than the thickness of the panels for projecting perpendicularly therefrom after assembly, to provide a clearance capable of accomodating an insulation means.

19. The building device of claim 18, wherein the upper surfaces of the lintels and the lower surface of the crank pieces are provided with grooves for facilitating the applying of an external coating on the insulation.

* * * * *